US007681996B2

(12) United States Patent
Kojima et al.

(10) Patent No.: US 7,681,996 B2
(45) Date of Patent: Mar. 23, 2010

(54) LIQUID EJECTION HEAD, METHOD OF MANUFACTURING LIQUID EJECTION HEAD, AND IMAGE FORMING APPARATUS

(75) Inventors: Toshiya Kojima, Kanagawa-ken (JP); Katsumi Enomoto, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 475 days.

(21) Appl. No.: 11/645,711

(22) Filed: Dec. 27, 2006

(65) Prior Publication Data

US 2007/0146440 A1 Jun. 28, 2007

(30) Foreign Application Priority Data

Dec. 28, 2005 (JP) ..... 2005-378974

(51) Int. Cl.
*B41J 2/045* (2006.01)

(52) U.S. Cl. ..... 347/68

(58) Field of Classification Search ..... 347/68, 347/70–72

See application file for complete search history.

(56) References Cited

U.S. PATENT DOCUMENTS 6,140,395 A * 10/2000 Hatsuda et al. ..... 523/319
6,979,078 B2 * 12/2005 Ito et al. ..... 347/71
7,213,912 B2 * 5/2007 Ito et al. ..... 347/72
7,305,764 B2 * 12/2007 Kitahara ..... 29/890.1

FOREIGN PATENT DOCUMENTS

JP 9-314831 A 12/1997
JP 9-314833 A 12/1997
JP 11-261186 A 9/1999

* cited by examiner

*Primary Examiner*—An H Do
(74) *Attorney, Agent, or Firm*—Birch, Stewart, Kolasch & Birch, LLP

(57) ABSTRACT

The liquid ejection head includes: a piezoelectric body which generates pressure for ejecting liquid; a pressure chamber which is connected to a nozzle; a common liquid chamber which is arranged across the piezoelectric body from the pressure chamber and has at least five molded walls that are integrally molded from a resin material; groove-shaped wires which include a first wire and a second wire and are formed on at least two of the molded walls of the common liquid chamber; a liquid supply flow channel which is provided in one of the molded walls that is adjacent to the pressure chamber in such a manner that the liquid supply flow channel is connected with the pressure chamber; and an electronic circuit which is arranged on one of the molded walls of the common liquid chamber, wherein the first wire is connected to the piezoelectric body and the second wire is connected to the electronic circuit.

5 Claims, 17 Drawing Sheets

LIQUID EJECTION HEAD, METHOD OF MANUFACTURING LIQUID EJECTION HEAD, AND IMAGE FORMING APPARATUS

BACKGROUND OF THE INVENTION

1. Field of the Invention

The present invention relates to a liquid ejection head, a method of manufacturing a liquid ejection head, and an image forming apparatus, and more particularly, it relates to an electronic circuit for controlling liquid ejection, an electrical wiring arrangement and structure, and a method of manufacturing such a structure.

2. Description of the Related Art

As an image forming apparatus in the related art, an inkjet printer (inkjet recording apparatus) is known, which comprises an inkjet printer head (liquid ejection head) having an arrangement of a plurality of liquid ejection nozzles and which records images on a recording medium by ejecting ink (liquid) from the nozzles toward the recording medium while causing the inkjet head and the recording medium to move relatively to each other.

Such an inkjet head of an inkjet printer of this kind has pressure generating units, each comprising, for example, a pressure chamber to which ink is supplied from an ink tank via an ink supply channel, a piezoelectric element which is driven by an electrical signal in accordance with image data, a diaphragm which constitutes a portion of the pressure chamber and deforms in accordance with driving of the piezoelectric element, and a nozzle which is connected to the pressure chamber and from which the ink inside the pressure chamber is ejected in the form of a droplet because of the volume of the pressure chamber being reduced by the deformation of the diaphragm. In such an inkjet printer, an image is formed on a recording medium by combining dots formed by ink ejected from the nozzles of the pressure generating units.

Ink ejection is thus controlled by transmitting electrical signals to the piezoelectric elements that are to be driven, and in order to transmit these electrical signals, electrical wires are provided on the perimeter of the ink tank. Various methods for installing these wires have been proposed in consideration of the various aspects, such as the number of components and the manufacturing costs.

For example, Japanese Patent Application Publication No. 9-314831 discloses an inkjet recording head comprising: a head main body having ink spraying ports and ink supply hole grooves; and a cover member which covers the ink grooves to form a liquid-tight seal. According to the inkjet recording head disclosed in Japanese Patent Application Publication No. 9-314831, it is possible to reduce the number of components and to achieve a simple manufacturing process, and moreover, the number of connections of electrical circuit components can be reduced and manufacturing costs can also be reduced.

Japanese Patent Application Publication No. 9-314833 discloses a method in which electrical signals are supplied to the piezoelectric elements by means of thin film transistors (TFTs). More specifically, electrodes are formed so as to extend to edge faces of drive substrates with which thin film transistors (TFTs) are provided, and the drive substrates are installed in a direction perpendicular to a direction in which piezoelectric elements are formed in such a manner that the electrodes on the edge faces of the drive substrates make contact with electrodes of the piezoelectric elements.

Moreover, Japanese Patent Application Publication No. 11-261186 discloses a structure in which an undulating-shaped mechanical coupling section of a module substrate has contact points and the substrate can be arranged in various directions. The contact points are connected together by means of soldering, brazing or mechanical caulking.

However, in the invention described in Japanese Patent Application Publication No. 9-314831, there is a problem in that since electrical contacts are provided, the reliability of the connections in the contact sections is poor. Furthermore, it is hard to actualize the invention since it is difficult to achieve accurate positioning in the cases of high-density wires. Since the cover member is formed by inflecting a film material, it does not maintain structural strength and does not function as a structural member.

Moreover, in the invention described in Japanese Patent Application Publication No. 9-314833, in compositional terms, it is necessary to connect the electrical wires by placing two substrates in contact with each other, and therefore it is difficult to achieve accurate positioning in cases of high-density wires, thus leading to a loss of reliability in the connections.

Furthermore, in the invention described in Japanese Patent Application Publication No. 11-261186, since there is a great amount of freedom of layout, then there is a merit in that the space can be used efficiently; however, since the connections are made mechanically, then their accuracy depends on the mechanical processing accuracy and hence it is difficult to apply it to high-density wiring.

As described above, it has been proposed that wiring be implemented in a three-dimensional fashion in the peripheral region of an inkjet printer head; however, many of these proposals involve connecting sections located at intermediate points of the wires. Hence, the greater the number of wires, the more difficult it becomes to achieve reliable electrical connections. Moreover, as the density of the wiring increases, the required level of processing accuracy in the materials becomes higher, and accurate positional registration becomes more difficult. This makes it even harder to achieve electrical connections.

Furthermore, in the related art, since the wiring sections are formed by a structure in which a plurality of components are bonded three-dimensionally or are formed by bending a film, then it is difficult to achieve the sufficient rigidity or airtightness of the structure.

SUMMARY OF THE INVENTION

The present invention has been contrived in view of the foregoing circumstances, an object thereof being to provide a composition of a liquid ejection head in which high-density wires are formed three-dimensionally and the structural rigidity and airtightness are ensured, a method of manufacturing such a liquid ejection head, and an image forming apparatus using such a liquid ejection head.

In order to attain the aforementioned object, the present invention is directed to a liquid ejection head comprising: a piezoelectric body which generates pressure for ejecting liquid; a pressure chamber which is connected to a nozzle; a common liquid chamber which is arranged across the piezoelectric body from the pressure chamber and has at least five molded walls that are integrally molded from a resin material; groove-shaped wires which include a first wire and a second wire and are formed on at least two of the molded walls of the common liquid chamber; a liquid supply flow channel which is provided in one of the molded walls that is adjacent to the pressure chamber in such a manner that the liquid supply flow channel is connected with the pressure chamber; and an electronic circuit which is arranged on one of the molded walls of the common liquid chamber, wherein the first wire is connected to the piezoelectric body and the second wire is connected to the electronic circuit.

According to this aspect of the present invention, it is possible to arrange the wires three-dimensionally at high density while the structural rigidity and airtightness are ensured.

Preferably, the groove-shaped wires are formed on outer surfaces of the at least two of the molded walls of the common liquid chamber.

Preferably, the molded walls of the common liquid chamber are formed from an epoxy resin containing inorganic particle fillers.

According to this aspect of the present invention, it is possible to further increase the rigidity of the common liquid chamber.

Preferably, the liquid ejection head further comprises a piezoelectric body cover which is installed so as to create a space above the piezoelectric body and which includes a first electrical connection hole, wherein: one of the molded walls of the common liquid chamber includes a second electrical connection hole; a conductive material is filled into both of the first electrical connection hole and the second electrical connection hole; and a diameter of the first electrical connection hole is greater than a diameter of the second electrical connection hole.

According to this aspect of the present invention, it is possible to establish the connection of the electrical wires further reliably.

In order to attain the aforementioned object, the present invention is also directed to a method of manufacturing a liquid ejection head comprising the steps of: forming a groove-shaped wire, a first liquid supply hole and a first electrical connection hole, on at least one of walls of a common liquid chamber; forming a second liquid supply hole and a second electrical connection hole in a piezoelectric body cover; bonding the piezoelectric body cover to the common liquid chamber; and filling a conductive material into both of the first electrical connection hole and the second electrical connection hole.

In order to attain the aforementioned object, the present invention is also directed to a method of manufacturing a liquid ejection head comprising the steps of: depositing fine metal particles on an upper surface of a projecting section of a die, the projecting section of the die being formed at a position corresponding to a region where a groove-shaped wire is to be formed on a wall of a common liquid chamber; pouring a resin material for forming the wall of the common liquid chamber, into the die after depositing the fine metal particles on the upper surface of the projecting section of the die, and solidifying the resin material in such a manner that the fine metal particles are transferred to the resin material; removing the die from the resin material after solidifying the resin material; and forming the groove-shaped wire by plating based on the fine metal particles transferred to the resin material.

According to this aspect of the present invention, it is possible to manufacture a liquid ejection head which enables three-dimensional wiring while the rigidity and airtightness are ensured.

In order to attain the aforementioned object, the present invention is also directed to an image forming apparatus comprising any one of the above-mentioned liquid ejection heads.

According to an image forming apparatus of this kind, the liquid ejection head can be miniaturized without giving rise to structural problems, and accordingly the overall image forming apparatus can be downsized.

As described above, according to the present invention, beneficial effects are obtained in that high-density wires can be manufactured readily in a three-dimensional configuration while the structural rigidity and airtightness is ensured in the composition of the liquid ejection head.

In other words, since there are no connecting sections at intermediate points of the wires, then reliable electrical connections can be achieved, and moreover, even in the case of high-density wires, it is possible to achieve highly reliable electrical connections without requiring accurate positional registration during the manufacture of the liquid ejection head.

Moreover, since the wiring sections are not formed by bending a film or by using a structure in which a plurality of components are bonded three-dimensionally, then the rigidity and airtightness of the structure can be ensured satisfactorily.

By using a liquid ejection head of compact dimensions, beneficial effects are obtained in that the overall size of the image forming apparatus can also be made more compact.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
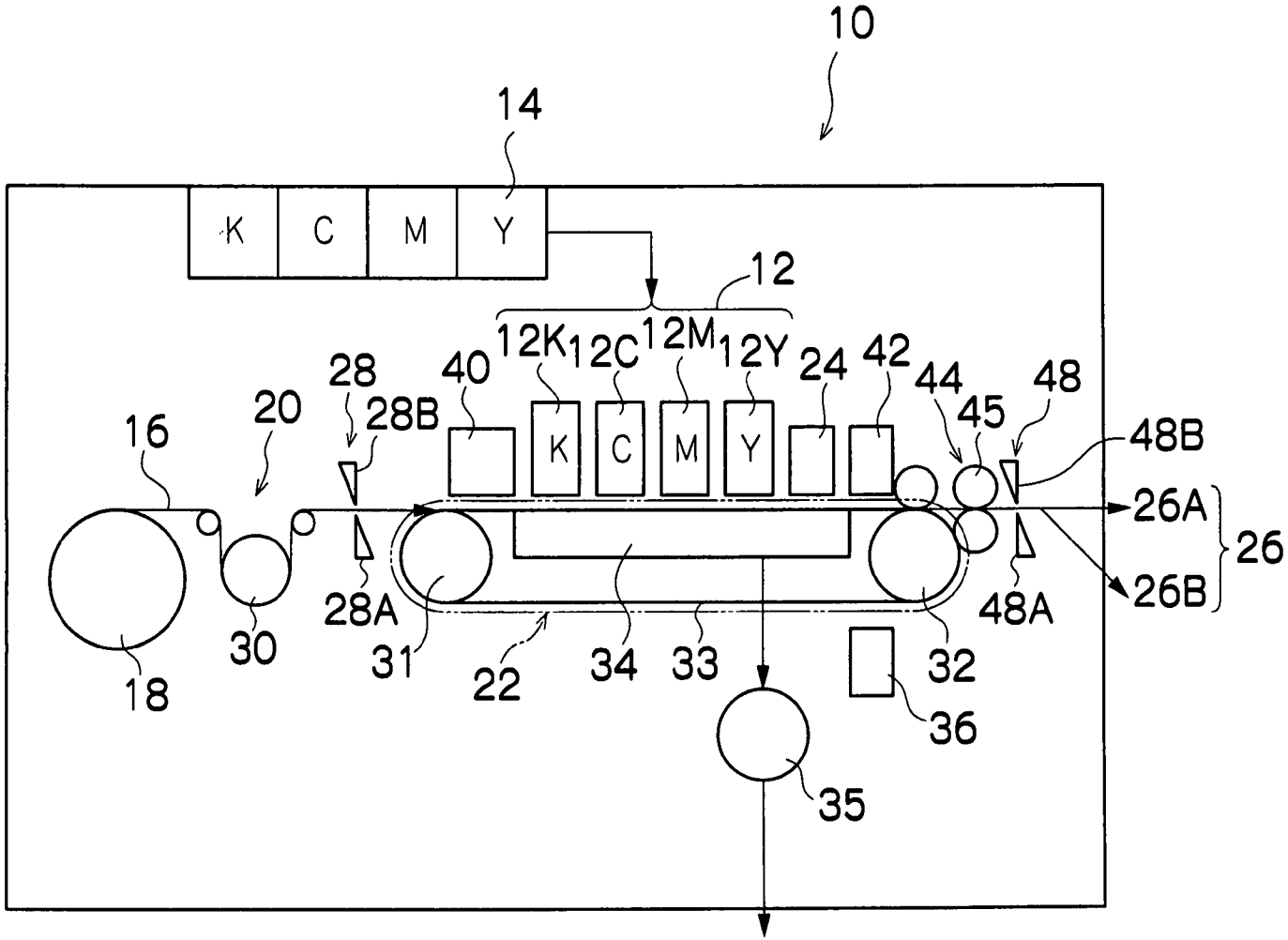
FIG. 1 is a general schematic drawing showing an approximate view of an inkjet recording apparatus forming an image forming apparatus comprising a liquid ejection head (inkjet head) according to an embodiment of the present invention.

FIG. 1 is a general schematic drawing showing an approximate view of an image forming apparatus comprising an inkjet head (liquid ejection head) according to an embodiment of the present invention.

As shown in FIG. 1, the inkjet recording apparatus 10 comprises: a print unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M, and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a belt conveyance unit 22 disposed facing the nozzle faces (ink-droplet ejection faces) of the print unit 12, for conveying the recording paper 16 while keeping the recording paper 16 flat; a print determination unit 24 for reading printed results produced by the print unit 12; and a paper output unit 26 for outputting image-printed recording paper (printed matter) to the exterior.

In FIG. 1, a magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which roll paper is used, a cutter 28 is provided as shown in FIG. 1, and the roll paper is cut to a desired size by the cutter 28. The cutter 28 has a stationary blade 28A whose length is not less than the width of the conveyor pathway of the recording paper 16, and a round blade 28B which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium, such as a bar code and a wireless tag, containing information about the type of paper be attached to the magazine. By reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in a direction opposite from the curl direction in the magazine. The heating temperature at this time is preferably controlled so that the recording paper 16 has a curl in which the surface on which the print is to be made is slightly round outward.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle faces of the print unit 12 and the sensor face of the print determination unit 24 forms a plane (flat plane).

There are no particular limitations on the structure of the belt conveyance unit 22, and it may use vacuum suction conveyance in which the recording paper 16 is conveyed by being suctioned onto the belt 33 by negative pressure created by suctioning air through suction holes provided on the belt surface, or it may be based on electrostatic attraction.

The belt 33 has a width that is greater than the width of the recording paper 16, and in the case of the above-described vacuum suction conveyance, a plurality of suction apertures (not shown) are formed on the belt surface. A suction chamber 34 is disposed in a position facing the sensor surface of the print determination unit 24 and the nozzle surfaces of the print unit 12 on the interior side of the belt 33, which is set around the rollers 31 and 32, as shown in FIG. 1; and a negative pressure is generated by suctioning air from the suction chamber 34 by means of a fan 35, thereby the recording paper 16 on the belt 33 is held by suction.

The belt 33 is driven in the clockwise direction in FIG. 1 by the motive force of a motor (not shown in drawings) being transmitted to at least one of the rollers 31 and 32, which the belt 33 is set around, and the recording paper 16 held on the belt 33 is conveyed from the left to the right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effects.

The inkjet recording apparatus 10 can comprise a roller nip conveyance mechanism instead of the belt conveyance unit 22. However, there is a drawback in the roller nip conveyance mechanism that the print tends to be smeared when the printing area is conveyed by the roller nip action because the nip roller makes contact with the printed surface of the paper immediately after the printing. Therefore, the suction belt conveyance in which nothing comes into contact with the image surface in the printing area is preferable.

A heating fan 40 is disposed on the upstream side of the print unit 12 in the conveyance pathway formed by the belt conveyance unit 22. The heating fan 40 blows heated air onto the recording paper 16 to heat the recording paper 16 immediately before the printing so that the ink deposited on the recording paper 16 dries more easily.

Figure 2:
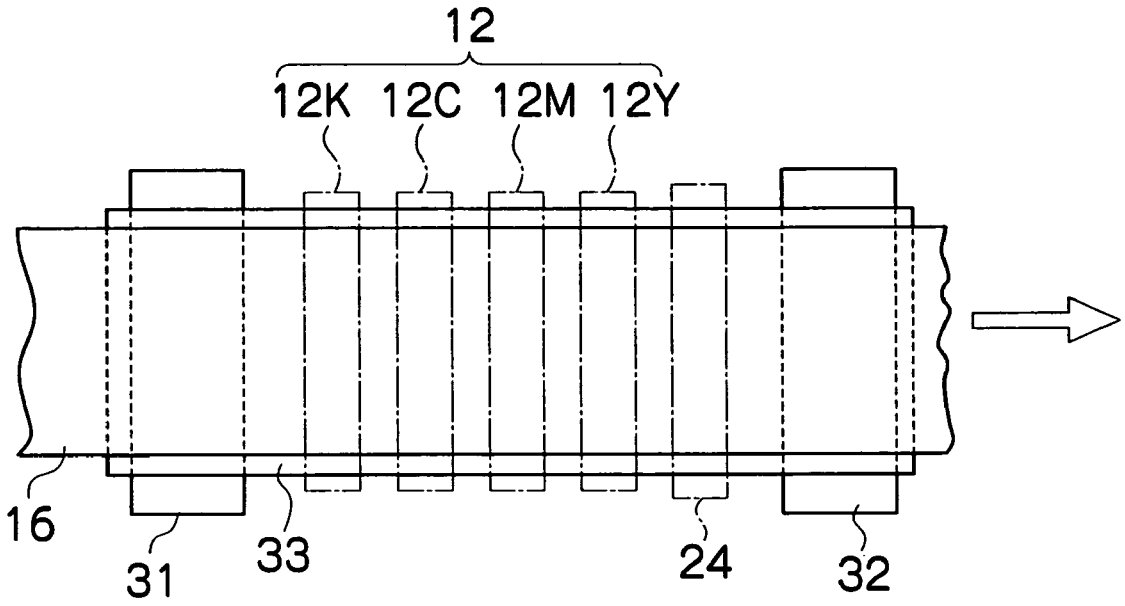
FIG. 2 is a principal plan diagram showing the periphery of a print unit of an inkjet recording apparatus forming an image forming apparatus comprising a liquid ejection head (inkjet head) according to an embodiment of the present invention.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction).

The print heads 12K, 12C, 12M, and 12Y are constituted by line heads in which a plurality of ink ejection ports (nozzles) are arranged through a length exceeding at least one side of the maximum size recording paper 16 intended for use with the inkjet recording apparatus 10.

The print heads 12K, 12C, 12M, and 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while the recording paper 16 is conveyed.

The print unit 12, which is constituted by the full-line heads that cover the entire width of the paper and are provided for the respective ink colors, can record an image over the entire surface of the recording paper 16 by performing an action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Here, the terms "main scanning direction" and "sub-scanning direction" are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action while the full-line head and the recording paper are moved relatively to each other. The direction in which sub-scanning is performed is called the sub-scanning direction. Consequently, the conveyance direction of the recording paper is the sub-scanning direction and the direction perpendicular to the sub-scanning direction is called the main scanning direction.

Although the configuration with the K, C, M, and Y four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor or the like) for capturing an image of the ink-droplet deposition results of the print unit 12, and functions as a device to check for ejection defects, such as clogs of the nozzles, from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substances that cause dye molecules to break down, and has the effects of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawings, the paper output unit 26A for the target prints is provided with a sorter for collecting the prints according to print orders.

The print heads 12K, 12C, 12M, and 12Y provided for the inks have a common structure, and therefore, a representative print head which represents the print heads and is labeled with the reference numeral 50 is discussed below.

Figure 3:
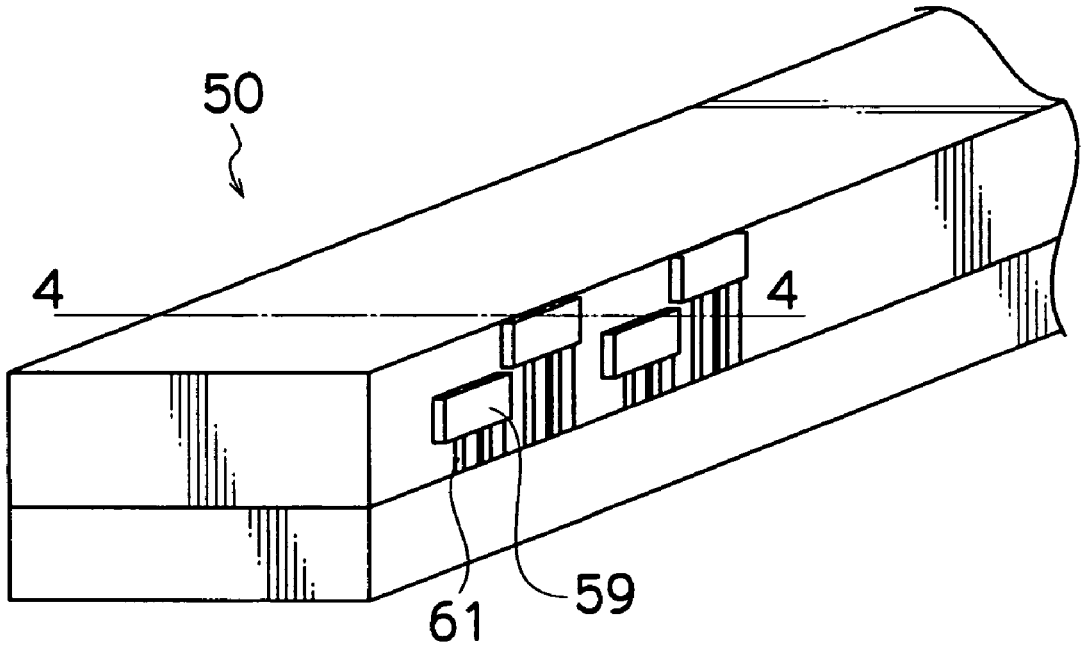
FIG. 3 is a general external view of a liquid ejection head according to a first embodiment of the present invention.

FIG. 3 is a general schematic diagram of a print head (liquid ejection head) 50 according to an embodiment of the present invention. Drive circuits 59 including integral circuits (i.e., ICs) for controlling the print head 50 are disposed on a side face of the print head 50, and electrical wires 61 are provided on the same side face.

Figure 4:
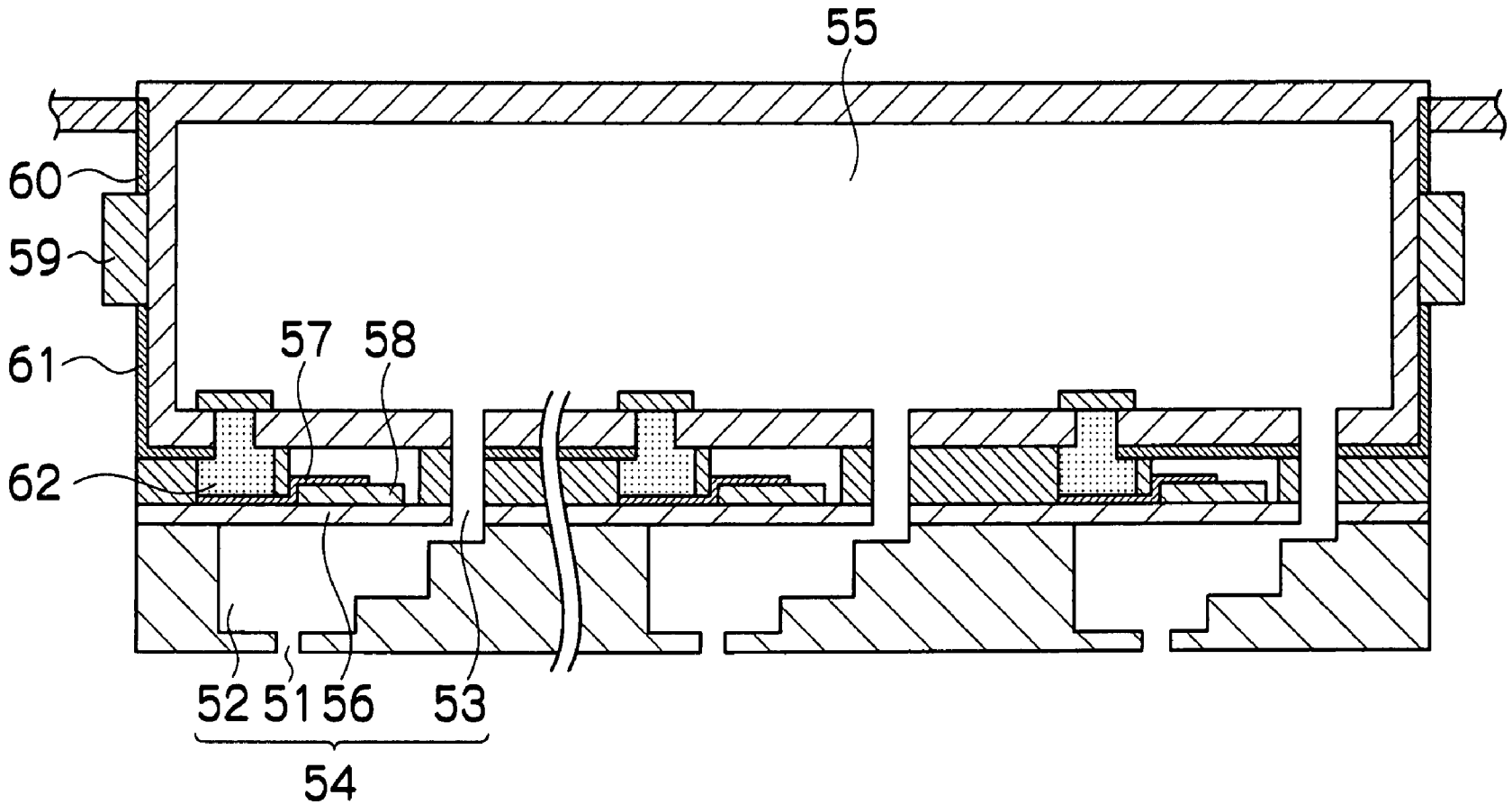
FIG. 4 is a cross-sectional diagram of a print head forming a liquid ejection head according to the first embodiment of the present invention.

FIG. 4 is a cross-sectional diagram along a vertical plane containing line 4-4 of the print head 50 shown in FIG. 3.

Each pressure chamber unit 54 includes a nozzle 51 which ejects ink and a pressure chamber 52, and it is connected to a common liquid chamber 55 by means of a supply port 53. Furthermore, one surface (in FIG. 4, the ceiling) of each pressure chamber 52 is constituted by a diaphragm 56, and piezoelectric elements 58 are bonded on top of the diaphragm 56. Each piezoelectric element 58 applies pressure to the diaphragm 56 so as to deform the diaphragm 56. An individual electrode 57 is formed on the upper surface of each piezoelectric element 58. The diaphragm 56 also serves as a common electrode.

Each of the piezoelectric elements 58 is interposed between the common electrode (diaphragm 56) and an individual electrode 57, and it is deformed when a drive voltage is applied between the common electrode (diaphragm 56) and the individual electrode 57. The diaphragm 56 is pressed by the deformation of each piezoelectric element 58, in such a manner that the volume of the corresponding pressure chamber 52 is reduced and ink is ejected from the corresponding nozzle 51. When the voltage applied between the common electrode (diaphragm 56) and the individual electrode 57 is released, the piezoelectric element 58 returns to its original position, the volume of the pressure chamber 52 returns to its original size, and new ink is supplied into the pressure chamber 52 from the common liquid channel 55 via the supply port 53.

In order to improve cooling effects, each drive circuit 59 including an IC is fixed to the surface of the exterior wall of the liquid ejection head, in a position corresponding to a position of the ink inside the common liquid chamber 55. The electrical wires 60 and 61 are connected to the drive circuit 59 (a plurality of electrical wires 61 are present, and the electrical wires 61 are simplified in FIG. 4), and input signals and output signals are transmitted via these electrical wires. Electrical signals are input to the drive circuits 59 including the ICs via the electrical wires 60, and electrical signals output from the drive circuits 59 including the ICs are transmitted to the individual electrodes 57 via the electrical wires 61 and through electrodes 62.

In ejecting ink, it is necessary to apply a drive voltage to each of the piezoelectric elements 58, and signals for application of the drive voltage are first input from the main body of the apparatus, via the electrical wires 60, to the drive circuits 59 including the ICs, whereupon desired drive control voltages are applied to the piezoelectric elements 58 via the electrical wires 61 and the through electrodes 62.

Figure 16:
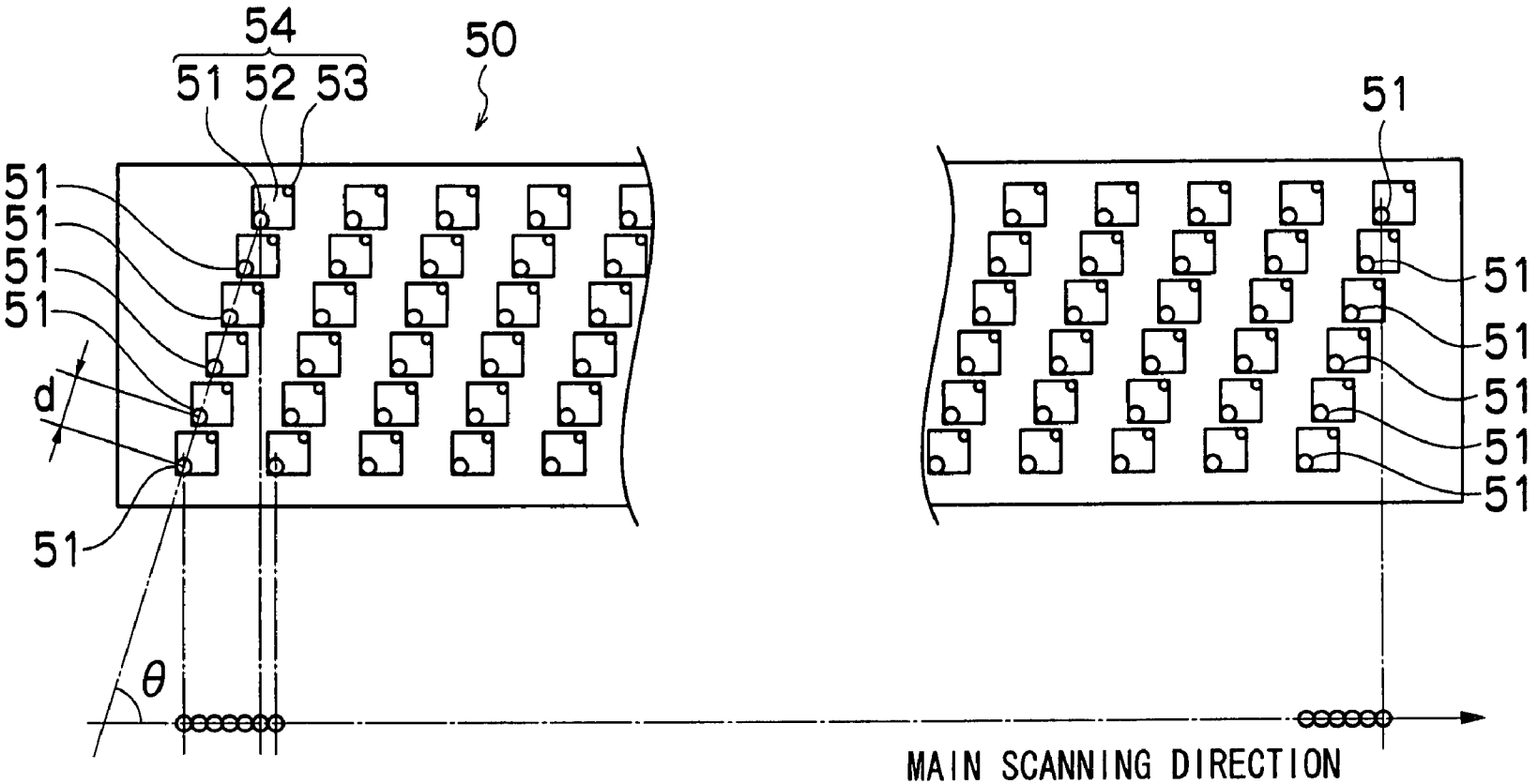
FIG. 16 is a plan perspective diagram showing an approximate view of a print head.

Next, the arrangement of nozzles (liquid ejection ports) in the print head (liquid ejection head) is described. The print heads 12K, 12C, 12M, and 12Y are provided for the respective ink colors and have the same structure, and the print head which is a representative embodiment of these print heads is denoted with the reference numeral 50. FIG. 16 is a diagram showing a plan view perspective diagram of the print head 50.

As shown in FIG. 16, the print head 50 according to the present embodiment achieves a high density arrangement of nozzles 51 by using a two-dimensional staggered matrix array of the pressure chamber units 54, each constituted by a nozzle 51 for ejecting ink in a form of ink droplets, a pressure chamber 52 for applying pressure to the ink in order to eject the ink, and an ink supply port 53 for supplying the ink to the pressure chamber 52 from the common liquid chamber (not shown in FIG. 16).

In the embodiment shown in FIG. 16, the pressure chambers 52 each have an approximately square planar shape when viewed from above, but the planar shape of the pressure chambers 52 is not limited to such a square shape. As shown in FIG. 16, each nozzle 51 is formed at one end of a diagonal of the corresponding pressure chamber 52, and each ink supply port 53 is provided at another of the corresponding pressure chamber 52.

Furthermore, although not shown in the drawings, one long full line head may be constituted by combining a plurality of short heads arranged in a two-dimensional staggered array, in such a manner that the combined length of this plurality of short heads corresponds to the full width of the print medium.

Figure 5:
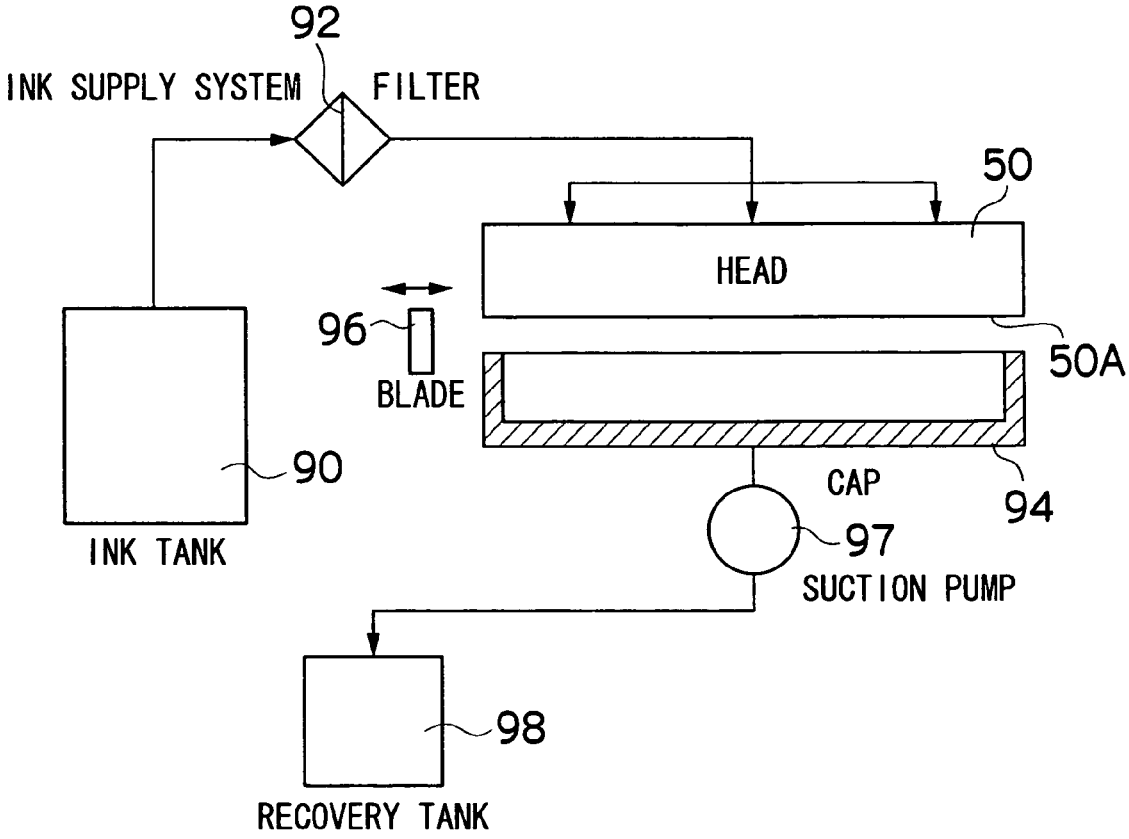
FIG. 5 is a general schematic drawing showing an approximate view of an ink supply system in an inkjet recording apparatus forming an image forming apparatus comprising a liquid ejection head (inkjet head) according to an embodiment of the present invention.

FIG. 5 is a schematic drawing showing the configuration of the ink supply system in the inkjet recording apparatus 10. An ink tank 90 is a base tank that supplies ink to the print head 50 and is set in the ink storing and loading unit 14 described above with reference to FIG. 1. The aspects of the ink tank 90 include a refillable type and a cartridge type: when the remaining amount of ink is low, the ink tank 90 of the refillable type is filled with ink through a filling port (not shown) and the ink tank 90 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 90 in FIG. 5 is equivalent to the ink storing and loading unit 14 in FIG. 1 described above.

A filter 92 for removing foreign matters and bubbles is disposed in the middle of the channel connecting the ink tank 90 and the print head 50 as shown in FIG. 5. The filter mesh size is preferably equivalent to or less than the diameter of the nozzle and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 includes: a cap 94 as a device to prevent the nozzles from drying out or to prevent an increase in the ink viscosity in the vicinity of the nozzles; and a cleaning blade 96 as a device to clean the nozzle face 50A.

A maintenance unit including the cap 94 and the cleaning blade 96 can be relatively moved with respect to the print head 50 by a movement mechanism (not shown), and is moved from a predetermined holding position to a maintenance position below the print head 50 as required.

The cap 94 is moved up and down relatively with respect to the print head 50 by an elevator mechanism (not shown). When the power is turned OFF or when in a print standby state, the elevator mechanism raises the cap 94 to a predetermined elevated position so that the cap 94 comes into close contact with the print head 50, and the nozzle region of the nozzle face 50A is thereby covered with the cap 94.

The cleaning blade 96 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 96 to slide over the nozzle surface 50A, thereby cleaning same.

During the printing or during the standby, if the use frequency of a particular nozzle 51 has declined and the ink viscosity in the vicinity of the nozzle 51 has increased, then a preliminary ejection is performed toward the cap 94, in order to remove the ink that has degraded as a result of increasing in the viscosity.

Also, when bubbles have become intermixed into the ink inside the print head 50 (the ink inside the pressure chambers 52), the cap 94 is placed on the print head 50, ink (ink in which bubbles have become intermixed) inside the pressure chambers 52 is removed by suction with a suction pump 97, and the ink removed by the suction is sent to a recovery tank 98. When ink is loaded into the print head for the first time or when the print head starts to be used after having been out of use for a long period of time, this suction operation is also carried out in order to suction and remove degraded ink which has hardened because of increasing in the viscosity.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the actuators (piezoelectric elements 58) for driving ejection are operated. Therefore, before reaching such a state, the piezoelectric elements 58 are operated toward an ink receptacle (in a viscosity range that allows the ink ejection by the operation of the piezoelectric elements 58), and a preliminary ejection is performed which causes the ink in the vicinity of the nozzles, which has increased in viscosity, to be ejected. Furthermore, after cleaning away soiling on the surface of the nozzle surface 50A by means of a wiper, such as the cleaning blade 96, provided as a cleaning device on the nozzle surface 50A, a preliminary ejection is also carried out in order to prevent infiltration of foreign matter into the nozzles 51 due to the rubbing action of the wiper. The preliminary ejection is also referred to as "dummy ejection", "purge", "liquid ejection", and so on.

When air bubbles have become intermixed in a nozzle 51 or a pressure chamber 52, or when the ink viscosity inside a nozzle 51 has increased beyond a certain level, ink can no longer be ejected from the nozzle 51 by means of a preliminary ejection, and hence a suctioning action is carried out as follows.

More specifically, when air bubbles have become intermixed into the ink inside the nozzles 51 or the pressure chambers 52, or when the viscosity of the ink inside the nozzles 51 has increased to a certain level or higher, ink can no longer be ejected from the nozzles 51 even if the piezoelectric elements 58 are operated. In a case of this kind, the cap 94 is placed on the nozzle surface 50A of the print head 50, and the ink containing air bubbles or the ink of increased viscosity inside the pressure chambers 52 is suctioned by the pump 97.

However, since this suction action is performed with respect to all the ink in the pressure chambers 52, the amount of ink consumption is considerable. Therefore, a preferred aspect is one in which a preliminary discharge is performed when the increase in the viscosity of the ink is small. Incidentally, the cap 94 described with reference to FIG. 5 functions as a suctioning device, and also functions as an ink receptacle for preliminary ejection.

Moreover, desirably, the inside of the cap 94 is divided by means of partitions, into a plurality of areas corresponding to the nozzle rows, thereby achieving a composition in which the suction can be performed selectively with respect to each of the demarcated areas, by means of a selector, or the like.

Figure 6:
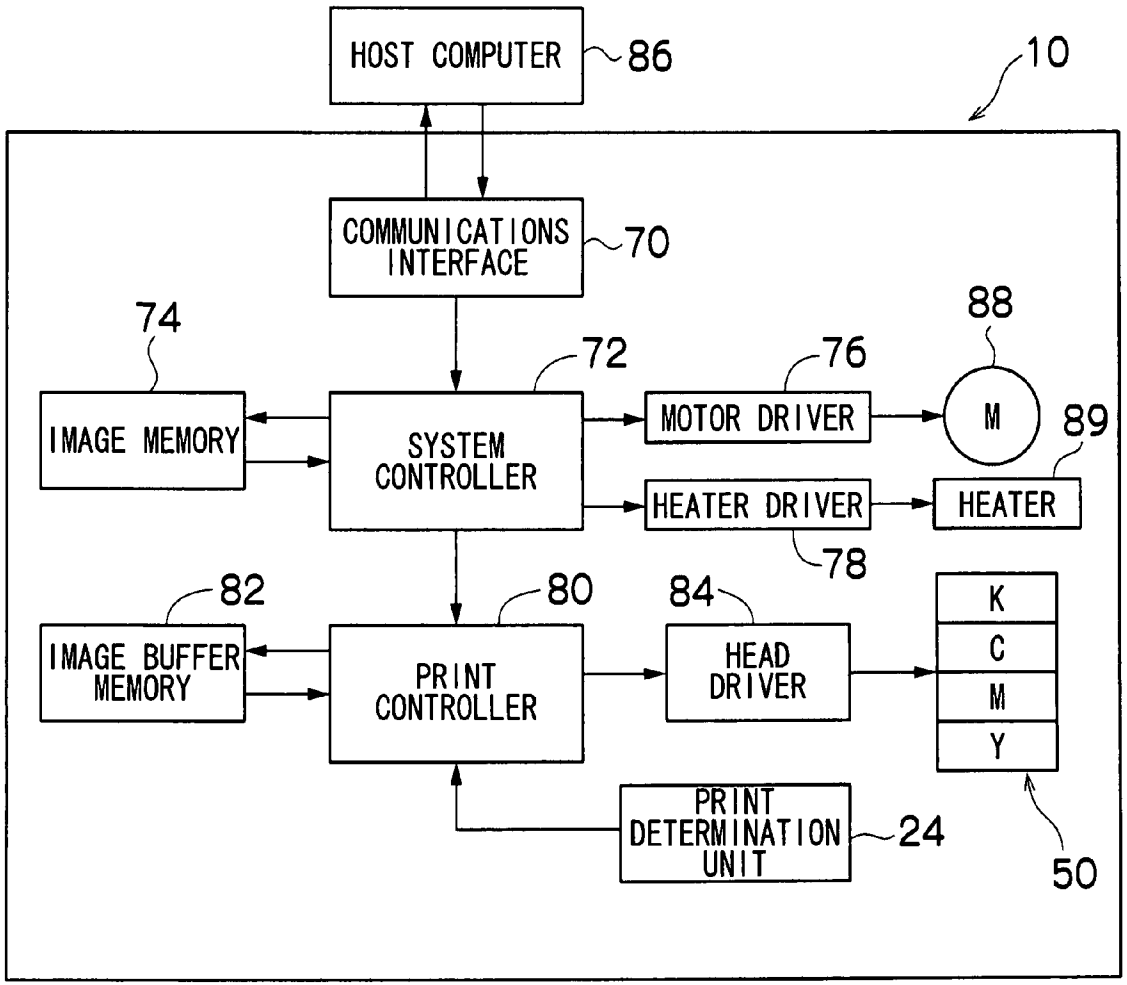
FIG. 6 is a block diagram showing the system composition of an inkjet recording apparatus forming an image forming apparatus comprising a liquid ejection head (inkjet head) according to an embodiment of the present invention.

FIG. 6 is a principal block diagram showing the system configuration of the inkjet recording apparatus 10. The inkjet recording apparatus 10 comprises a communications interface 70, a system controller 72, an image memory 74, a motor driver 76, a heater driver 78, a print controller 80, an image buffer memory 82, a head driver 84, and the like.

The communications interface 70 is an interface unit for receiving image data sent from a host computer 86. A serial interface, such as USB, IEEE1394, Ethernet, wireless network, or a parallel interface such as a Centronics interface, may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the image memory 74. The image memory 74 is a storage device for temporarily storing images inputted through the communications interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, and the like, it also generates control signals for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42, and the like, in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signals (print data) to the head driver 84. Required signal processing is carried out in the print controller 80, and the ejection amount and the ejection timing of the ink droplets from the respective print heads 50 are controlled via the head driver 84, on the basis of the print data. By this means, desired dot size and dot positions can be achieved.

The image buffer memory 82 is provided with the print controller 80; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 of the print head 50 on the basis of print data supplied from the print controller 80. The head driver 84 may include a feedback control system for maintaining constant drive conditions for the print heads.

The print determination unit 24 is a block that includes the line sensor (not shown) as described above with reference to FIG. 1, reads images printed on the recording paper 16, determines the print conditions (presence of the ejection, variation in the dot formation, and the like) by performing required signal processing, and the like, and provides the determination results of the print conditions to the print controller 80.

According to requirements, the print controller 80 makes various corrections with respect to the print head 50 on the basis of information obtained from the print determination unit 24.

Next, a method of manufacturing the print head 50 is described.

Figure 7A:
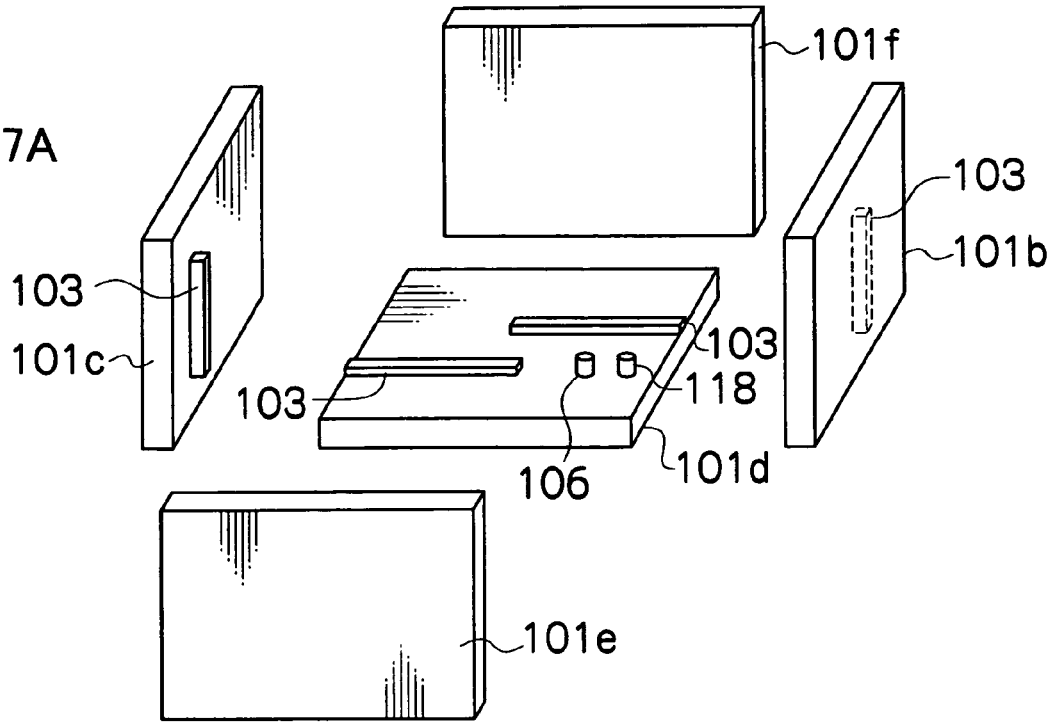
FIGS. 7A to 7C are diagrams showing steps for forming walls in a method of manufacturing a liquid ejection head according to the first embodiment of the present invention.
Figure 7B:
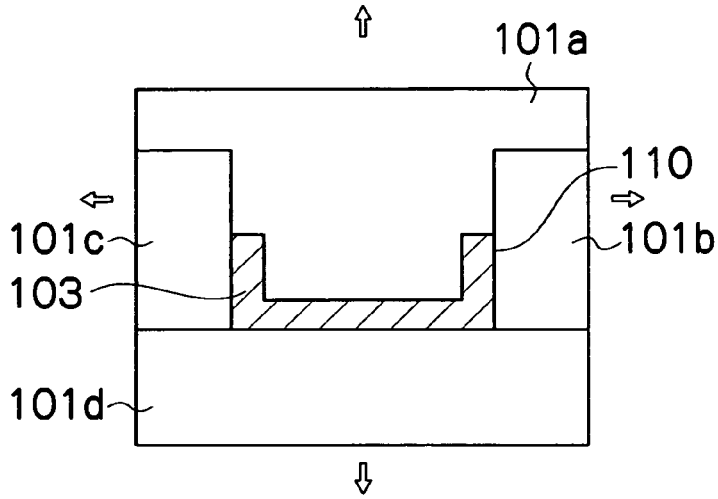
Figure 7C:
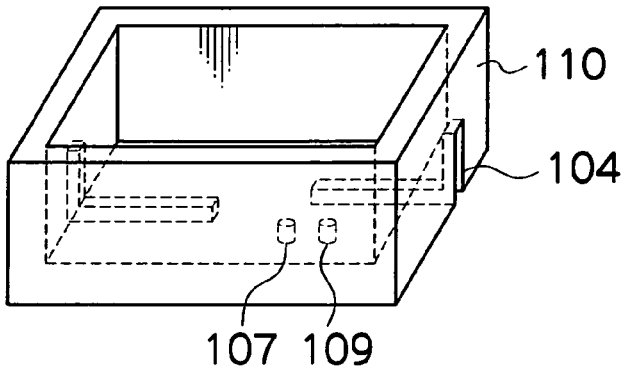

FIGS. 7A to 7C are illustrative diagrams showing a conceptual view of a method of manufacturing walls of the common liquid chamber 55 of the print head 50.

Partition walls 110 of the common liquid chamber 55 are formed by epoxy resin, or the like, and dies are used in forming the partition walls 110 of the common liquid chamber 55. FIG. 7A is an exploded diagram of dies used for forming the partition walls 110 of the common liquid chamber 55, and FIG. 7B is a cross-sectional diagram showing a state where the partition walls 110 of the common liquid chamber 55 are being formed by combining these dies. The dies for forming the partition walls 110 are constituted by six dies 101*a*, 101*b*, 101*c*, 101*d*, 101*e*, and 101*f*, and these dies 101*a*, 101*b*, 101*c*, 101*d*, 101*e*, and 101*f* are adjusted in prescribed positions and assembled together. Thereupon, epoxy resin is caused to flow into the space inside the die assembled by these dies 101*a*, 101*b*, 101*c*, 101*d*, 101*e*, and 101*f*. Projecting sections 103 for forming grooves for the wire sections are provided in the dies 101*b*, 101*c*, and 101*d*. Moreover, a projecting section 106 for forming an electrical connection hole passing through the resin, and a projecting section 118 for forming an ink supply hole are provided on the die 101*d* (although there are in reality a plurality of projecting sections 103, 106, and 118, a portion of these sections is omitted in FIGS. 7A to 7C). After the epoxy resin is solidified, by removing the dies 101*a*, 101*b*, 101*c*, 101*d*, 101*e*, and 101*f* in the directions denoted with arrows shown in FIG. 7B, the partition walls 110 for the common liquid chamber 55 including grooves 104 for electrical wires, electrical connection holes 107 and ink supply holes 109 are formed, as shown in FIG. 7C.

The rigidity can be increased by incorporating silica or alumina into the epoxy resin used. In such a case, it is possible to achieve excellent mechanical strength, and sufficient strength and liquid sealing properties for accumulating the ink can be ensured. Furthermore, in this case, in comparison with a case where it is formed of resin only (i.e., a resin material without silica or alumina), the coefficient of linear expansion can be restricted to a similar value to that of metal, and hence a merit is obtained in that differential expansion during the bonding can be reduced in a case where the basic composition of the head (the basic composition of the pressure chamber units 54 shown in FIG. 4) is made of metal. Moreover, since the resin used is a thermosetting resin, the resin is able to withstand the heat generated during solder reflow for installing the ICs.

Figure 8A:
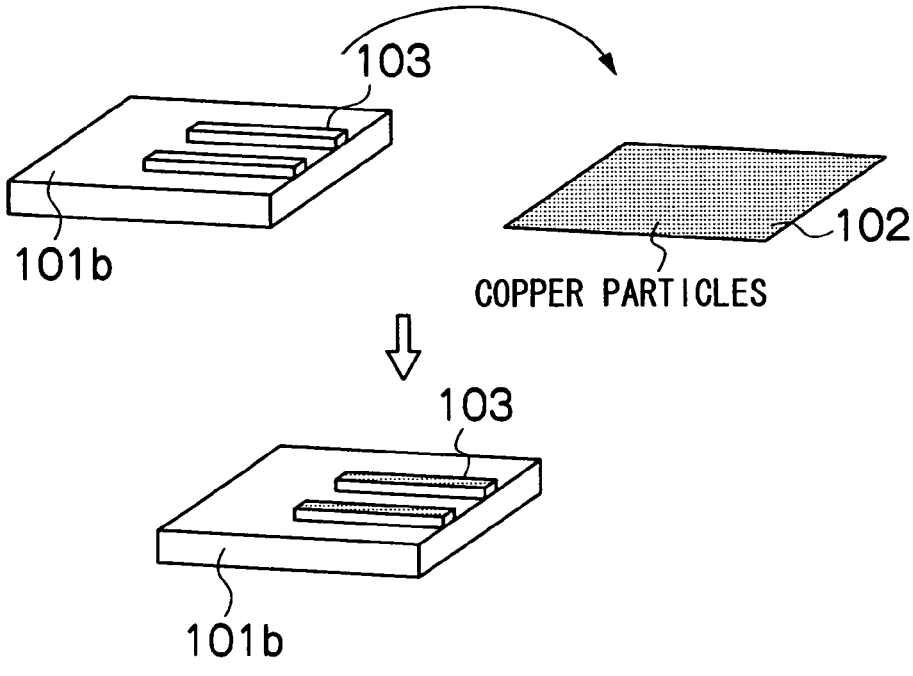
FIGS. 8A to 8C are diagrams showing steps for forming electrodes in a method of manufacturing a liquid ejection head according to the first embodiment of the present invention.
Figure 8B:
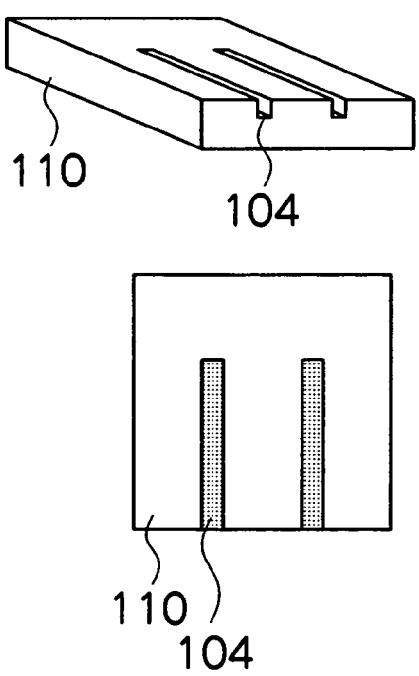
Figure 8C:
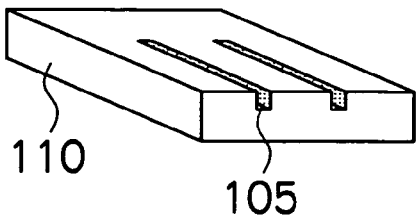

Next, the principles of a method of forming electrical wires are described with reference to FIGS. 8A to 8C.

Before assembling the dies in order to form the partition walls 110 from epoxy resin as described above, as shown in FIG. 8A, copper particles are adhered only to the outermost surfaces of the projecting sections 103 which are provided with the die 101*b* and serve to form grooves, by bringing the projecting sections 103 into contact with very fine copper particles 102.

A similar process is carried out with respect to the dies 101*c* and 101*d* as well, whereupon the dies are registered in position to assemble the dies as described above, and epoxy resin is caused to flow into the dies, thereby forming the partition walls 110. In so doing, the fine particles of copper adhere to the grooves 104 in the partition walls 110, and even when the dies 101*b*, 101*c*, and 101*d* have been removed, the very fine particles of copper remain adhering to the grooves 104 of the partition walls 110. FIG. 8B shows an oblique view and a plan view of one face of a partition wall 110 in this state.

Thereupon, by carrying out electroless plating in such a manner that metal is deposited only onto the recess sections of the grooves 104 for electrical wiring, on which the fine particles of copper are adhering, electrodes 105 are formed. FIG. 8C is a diagram showing a conceptual oblique diagram of a state of one surface of a partition wall 110 in this state.

Figure 9A:
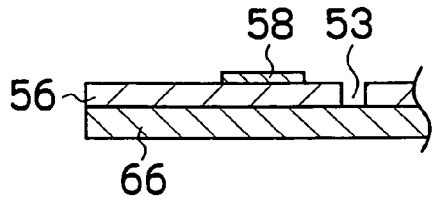
FIGS. 9A to 9G are diagrams showing steps for manufacturing a print head in a method of manufacturing a liquid ejection head according to the first embodiment of the present invention.
Figure 9B:
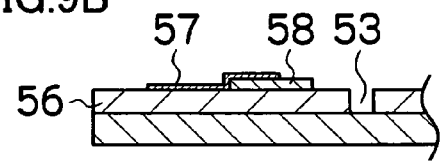

By means of the method shown in FIGS. 7A to 8C, the partition walls 110 of the common liquid chamber 55 having the electrodes on the exterior walls thereof are formed. The method of manufacturing a liquid ejection head by bonding the pressure chambers, and the like, to the under side of the common liquid chamber is described below with reference to FIGS. 9A to 9G As shown in FIG. 9A, on top of a dummy substrate 66, the piezoelectric elements 58 are formed on the diaphragm 56 which also serves as the common electrode and has holes that are to constitute a portion of the ink supply ports 53. The dummy substrate 66 is used in order to provide additional strength during the manufacturing process. Moreover, although not shown in FIGS. 9A to 9G, the surface of the diaphragm 56, which also serves as the common electrode, is covered with a thin insulating film in the regions other than the portions where the piezoelectric elements 58 are formed. Thereupon, as shown in FIG. 9B, the individual electrodes 57 are formed respectively on top of the piezoelectric elements 58.

Figure 9C:
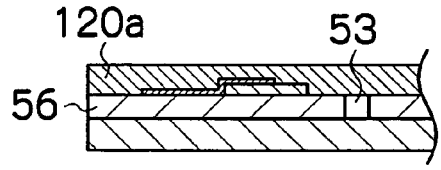
Figure 9D:
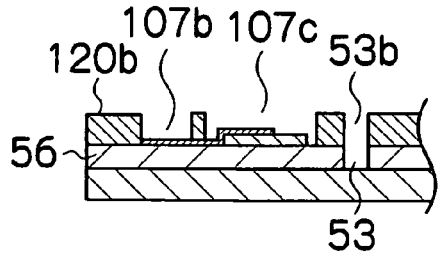

A photosensitive resin film 120*a* is then applied on the top by spin coating, or another technique, as shown in FIG. 9C. Subsequently, exposure and development are carried out using an exposure apparatus, and a portion of the photosensitive resin is removed as shown in FIG. 9D, thereby forming spaces 107*c* for ensuring the vibration of the piezoelectric elements, electrical connection holes 107*b*, ink supply holes 53*b*, and piezoelectric element covers 120*b* for the piezoelectric elements 58. The photosensitive resin used here may be SU-8 manufactured by Kayaku Microchem Corp., but it is not limited to this material.

Figure 9E:
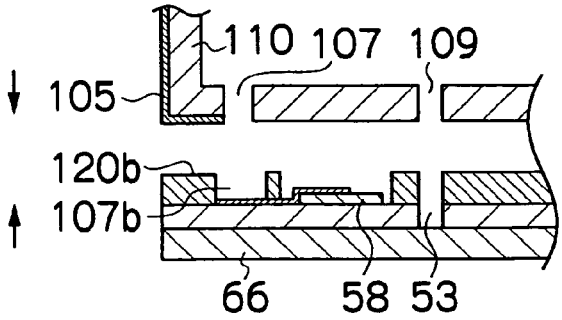
Figure 9F:
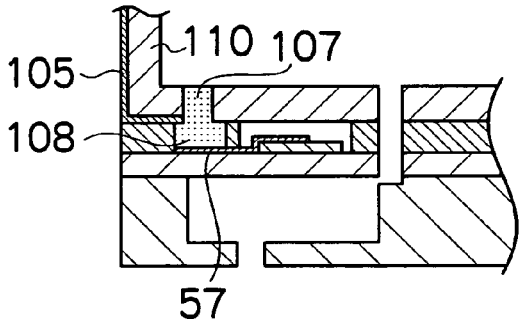
Figure 9G:
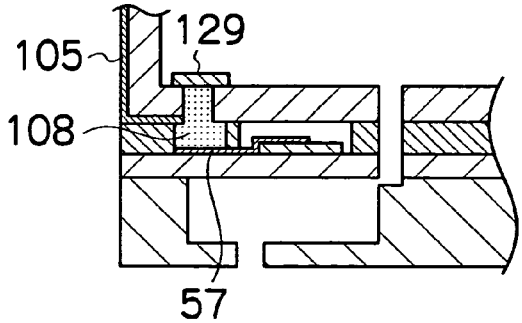

As shown in FIG. 9E, the structure thus formed is bonded with the partition walls 10 of the common liquid chamber 55 installed with electrical wires 105 as manufactured by the process described previously. In this case, position adjustment of the members is carried out before the bonding in such a manner that ink is able to pass through the ink supply ports 53. Thereupon, as shown in FIG. 9F, conductive material, such as a conductive paste or solder balls, is caused to flow into the electrical connection holes 107, and solder reflow, or the like, is carried out as necessary, thereby forming through electrodes 108 which connect the individual electrodes 57 with the electrical wires 105 respectively. In this process, if the electrical connection holes 107 formed in the partition wall 110 are made to be smaller than the portions of the electrical connection holes 107*b* where the through electrodes 108 are formed, then it is possible to achieve reliable electrical connections between the individual electrodes 57 and the electrodes 105. Thereupon, the dummy substrate 66 is removed and members constituting pressure chamber units 54 as shown in FIG. 4 are attached, thereby obtaining a structure shown in FIG. 9F. An insulating film 129 is then formed on the surface of each of the through electrodes 108 as shown in FIG. 9G, and the liquid ejection head is thus completed.

Figure 10:
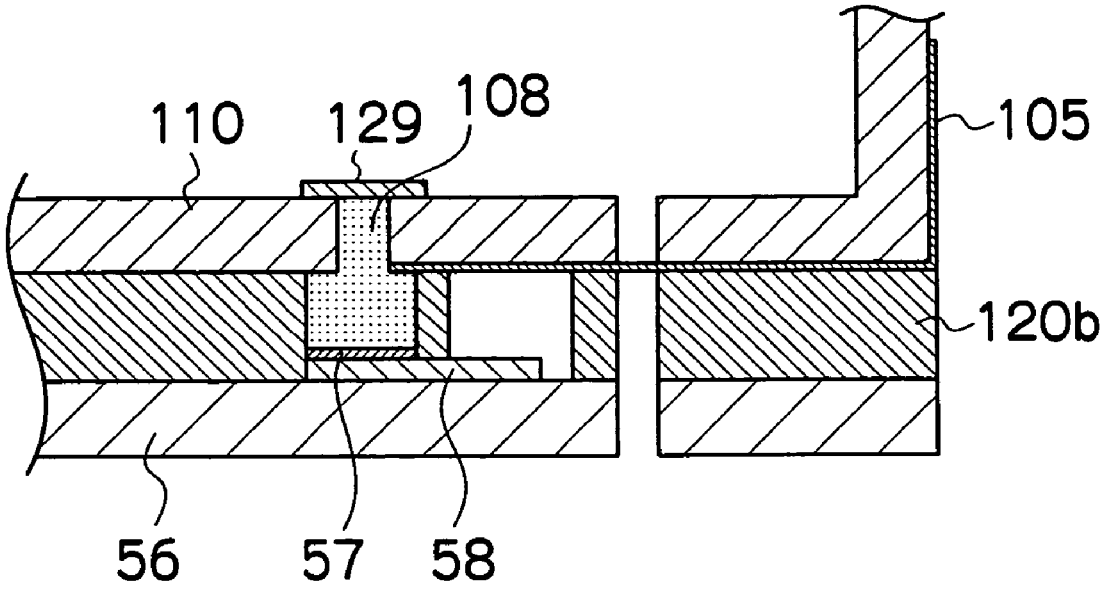
FIG. 10 is a cross-sectional diagram showing a further embodiment of the composition of a liquid ejection head according to the first embodiment of the present invention.

FIG. 10 is a diagram showing one embodiment of a further composition of the print head. By providing electrical connection holes on the piezoelectric elements 58 and forming the through electrodes 108 by causing conductive material to flow into these holes, it is possible to achieve a composition in which there are no concerns about disconnections which can be caused by step differences, or the like.

Figure 11A:
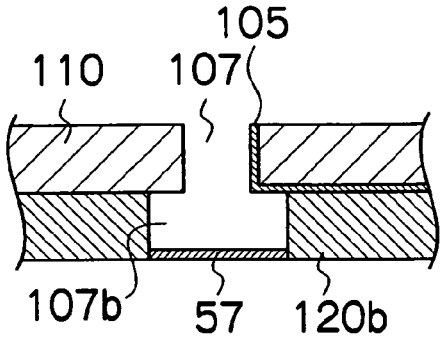
FIGS. 11A to 11D are structural diagrams showing embodiments of electrode forming according to the first embodiment of the present invention.
Figure 11B:
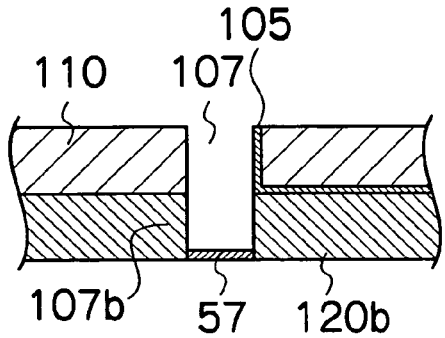

Furthermore, as shown in FIG. 11A, in a case where the diameter of the electrical connection holes 107 provided in the partition wall 110 is made smaller than the diameter of the electrical connection holes 107*b* provided in the piezoelectric element cover 120*b*, if the electrodes 105 are formed to wrap around into the electrical connection holes 107 in the partition wall 110, then it is possible to increase the contact surface area between the conductive material such as conductive paste, and the electrode 105. In such a case, a dependable electrical connection can be achieved between the electrodes 105 and the individual electrodes 57, thus improving the reliability yet further.

Figure 11C:
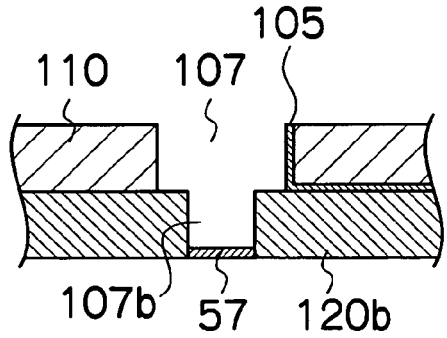

In cases where the electrodes 105 are formed so as to wrap around into the electrical connection holes 107 provided in the partition wall 110, even if the diameter of each electrical connection hole 107 provided in the partition wall 110 and the diameter of each electrical connection hole 107*b* provided in the piezoelectric element cover 120*b* are substantially the same as shown in FIG. 11 B, or even if the diameter of each electrical connection hole 107 provided in the partition wall 110 is larger than the diameter of each electrical connection hole 107*b* provided in the piezoelectric element cover 120*b* as shown in FIG. 11C, it is still possible to achieve a dependable electrical connection between the electrodes 105 and the individual electrodes 57, and therefore the sufficient reliability can be ensured.

Figure 11D:
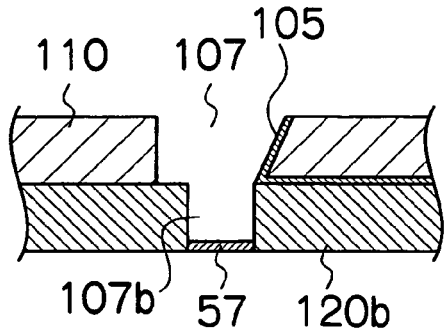

Moreover, in a case where the electrical connection holes 107 in the partition wall 110 are formed with a tapered shape, as shown in FIG. 11D, the conductive material flows more readily into the electrical connection holes 107 and 107*b*, and therefore the reliability is enhanced yet further.

Example of Liquid Ejection Head

Below, a practical example of a liquid ejection head relating to the present embodiment is described with reference to FIG. 3.

The liquid ejection head has a piezoelectric element density of 2400 dpi, and the electrical wires 61 at the highest wiring density have an L/S (line/space) ratio of 5/5 μm. The input wires to the electrical circuits have an L/S (line/space) ratio of 15/15 μm to 50/50 μm, and in the electrical wires 61, the L/S (line/space) ratio is changed to 5/5 μm in accordance with the density of the piezoelectric elements. In this case, the extended electrical wires 61 are connected to the drive circuits 59 including the ICs, and the electrical circuits (i.e., the drive circuits 59) are not arranged linearly but rather are staggered vertically between different levels, in accordance with the positions of the electrodes to which the wires 61 are connected.

Next, a second embodiment of the liquid ejection head according to the present invention is described.

In the second embodiment, electrical wires are formed on the inner side of the partition walls forming the common liquid chamber 55.

Figure 12:
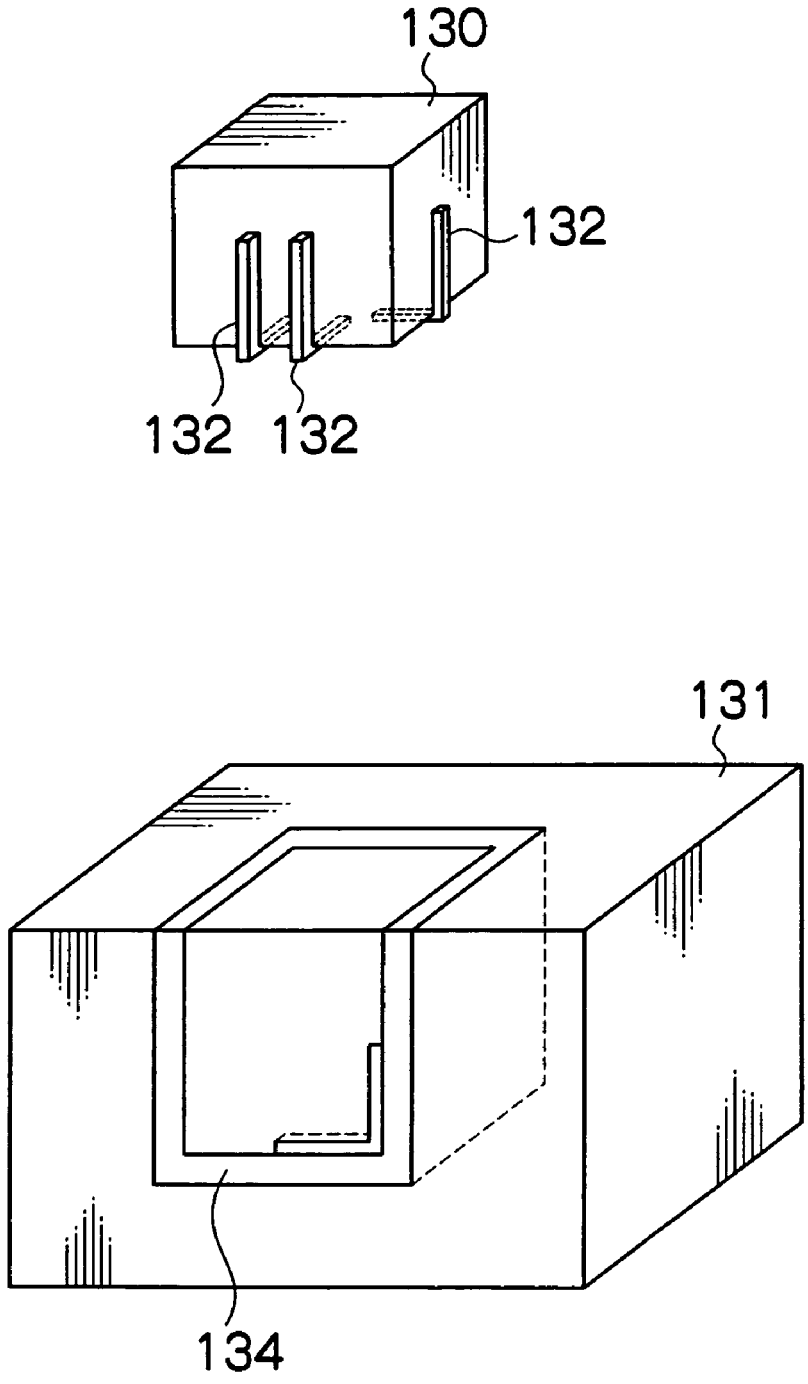
FIG. 12 illustrates a method of manufacturing walls of a liquid ejection head according to a second embodiment of the present invention.

FIG. 12 shows a die required in order to form electrical wires on the inner side of walls 134. The die includes an outer die 131 and an inner die 130, and projecting sections 132 for creating grooves for forming electrodes are provided with the inner die 130. Very fine metal particles of copper, or the like, adhere to the surfaces of the projecting sections by means of a step similar to that in the process of the first embodiment.

Epoxy resin is caused to flow into a space between the inner die 130 and the outer die 131, and a print head is formed by a method similar to that described in the first embodiment. Since the electrodes are formed on the inner side, a structure for preventing corrosion and shorting is obtained by covering all of the electrodes with an inorganic insulating film, such as silica, alumina or the like, or an organic insulating film. In FIG. 12, the die have a cube shape, but by forming the die with a frustum shape of square pyramid (i.e., a structure where the upper surface of the die 130 in the diagram is broader and the lower face of the die 130 is narrower), when integrated molding is carried out, it becomes easier to release the molding from the dies after the forming.

Figure 13:
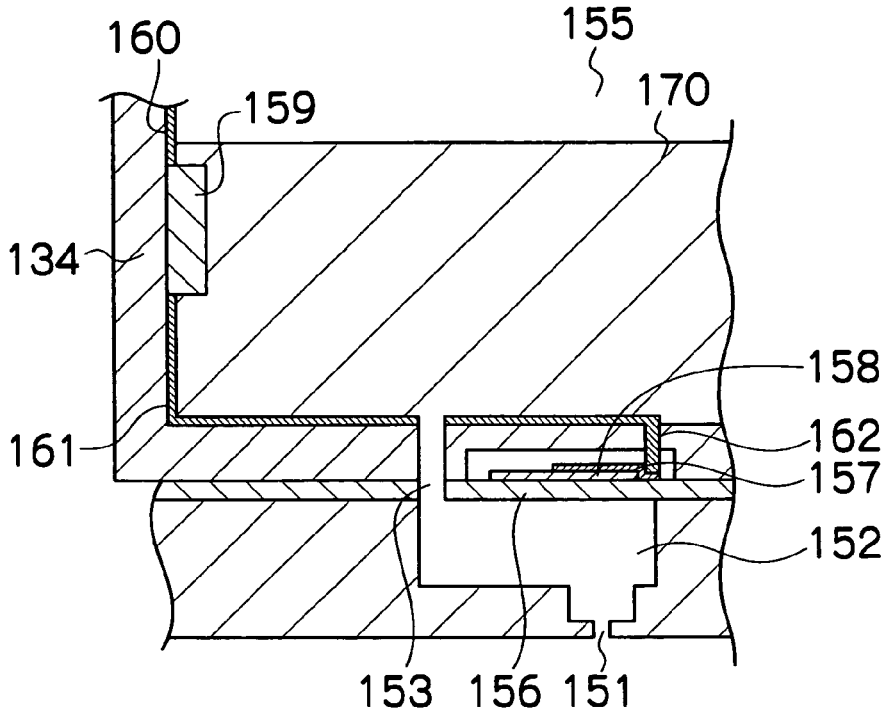
FIG. 13 is a cross-sectional diagram showing an embodiment of the composition of a liquid ejection head according to the second embodiment of the present invention.

FIG. 13 shows a cross-sectional diagram of one embodiment of the print head manufactured by this method.

In the present embodiment, drive circuits 159 including ICs are fixed to the inner part of the wall 134 of the common liquid chamber 155, and electrical wires 160 and 161 are connected to the drive circuits 159. Since the drive circuits 159 and the electrical wires 160 and 161 are formed on the inner wall of the common liquid chamber 155 and make contact with the ink, the surfaces of the drive circuits 159 including the IC and the surfaces of the electrical wires 160 and 161 are covered with an insulating material. The input signals and output signals are transmitted via these electrical wires (i.e., the electrical wires 160 and 161). Electrical signals are input to the drive circuits 159 including the IC via the electrical wire 160, and electrical signals output from the drive circuits 159 including the IC are transmitted to the individual electrodes 157 via the electrical wires 161 and through electrodes 162.

Each pressure chamber unit includes a nozzle 151 which ejects ink 170 and a pressure chamber 152, and it is connected to the common liquid chamber 155 which supplies the ink 170 by means of a supply port 153. One surface (which corresponds to the ceiling, in FIG. 13) of each pressure chamber 152 is constituted by a diaphragm 156, and piezoelectric elements 158 which cause the diaphragm 156 to be deformed by applying pressure to the diaphragm 156 are bonded on top of the diaphragm 156. An individual electrode 157 is formed on the upper surface of each piezoelectric element 158. Moreover, the diaphragm 156 also serves as a common electrode.

Each piezoelectric element 158 is interposed between the common electrode (diaphragm 156) and an individual electrode 157, and it is deformed when a drive voltage is applied to these two electrodes 156 and 157. The diaphragm 156 is pressed by the deformation of each piezoelectric element 158, in such a manner that the volume of the corresponding pressure chamber 152 is reduced, and the ink 170 is thereby ejected from the corresponding nozzle 151. When the voltage applied between the two electrodes 156 and 157 is released, the piezoelectric element 158 returns to its original position, the volume of the pressure chamber 152 returns to its original size, and new ink 170 is supplied into the pressure chamber 152 from the common liquid chamber 155 via the supply port 153.

Figure 14:
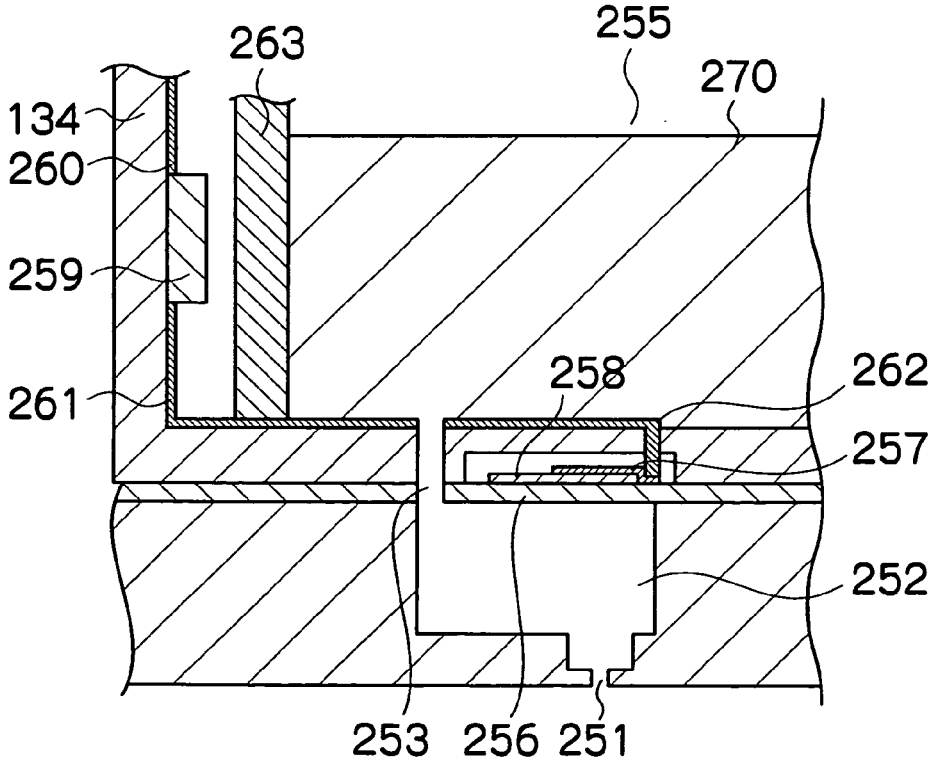
FIG. 14 is a cross-sectional diagram showing another embodiment of the composition of a liquid ejection head according to the second embodiment of the present invention.

FIG. 14 shows a cross-sectional diagram of a further embodiment of the print head.

In this case, a separating partition 263 is provided in such a manner that drive circuits 259 including ICs which are fixed to the inner surface of the wall 134 are separated from the ink 270. According to this composition, the drive circuits 259 including the ICs are protected from the ink 270. Since the wires are provided on the inner wall, then the surfaces of the electrical wires 260 and 261 are covered with an insulating material.

The electrical wires 260 and 261 are connected to the drive circuits 259, and input signals and output signals are transmitted via these electrical wires. Electrical signals are input to the drive circuits 259 including the ICs via the electrical wires 260, and electrical signals output from the drive circuits 259 including the ICs are transmitted to the individual electrodes 257 via the electrical wires 261 and through electrodes 262.

Each pressure chamber unit includes a nozzle 251 which ejects ink 270 and a pressure chamber 252, and it is connected to a common liquid chamber 255 which supplies ink 270 by means of a supply port 253. One surface (which corresponds to the ceiling, in FIG. 14) of each pressure chamber 252 is constituted by a diaphragm 256, and piezoelectric elements 258 which cause the diaphragm 256 to be deformed by applying pressure to the diaphragm 256 are bonded on top of the diaphragm 256. An individual electrode 257 is formed on the upper surface of each piezoelectric element 258. Moreover, the diaphragm 256 also serves as a common electrode.

Each piezoelectric element 258 is interposed between the common electrode (diaphragm 256) and an individual electrode 257, and it is deformed when a drive voltage is applied to these two electrodes 256 and 257. The diaphragm 256 is pressed by the deformation of each piezoelectric element 258, in such a manner that the volume of the corresponding pressure chamber 252 is reduced, and the ink 270 is thereby ejected from the corresponding nozzle 251. When the voltage applied between the two electrodes 256 and 257 is released, the piezoelectric element 258 returns to its original position, the volume of the pressure chamber 252 returns to its original size, and new ink 270 is supplied into the pressure chamber 252 from the common liquid chamber 255 via the supply port 253.

Figure 15:
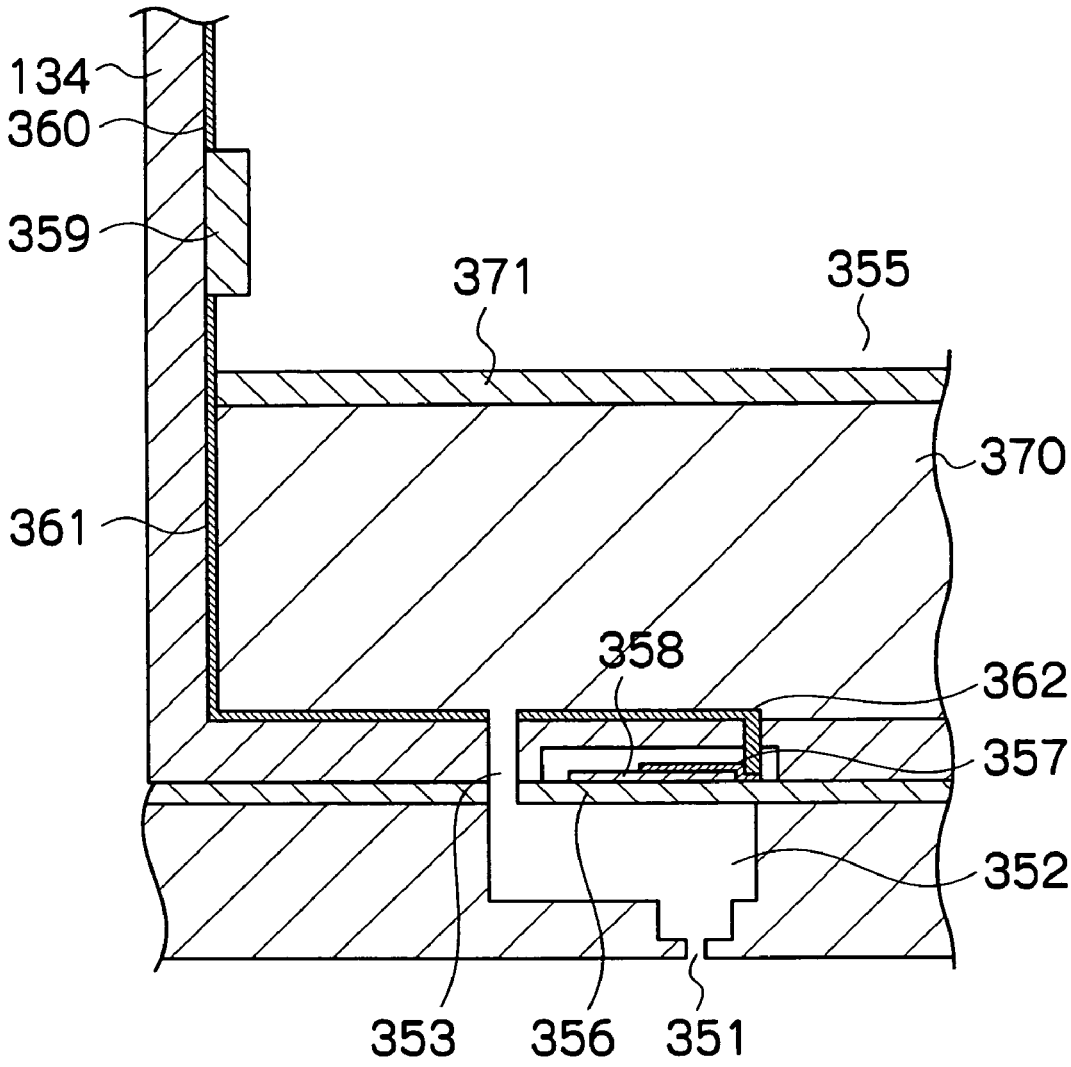
FIG. 15 is a cross-sectional diagram showing another embodiment of the composition of a liquid ejection head according to the second embodiment of the present invention.

FIG. 15 shows a cross-sectional diagram of a further embodiment of the print head.

In this case, drive circuits 359 including ICs fixed to the inner side of the wall 134 are disposed above the liquid surface of the ink 370 in such a manner that the drive circuits 359 are separated from the ink 370, and moreover, an upper cover 371 is provided on the liquid surface of the ink 370, thereby preventing the ink 370 from adversely affecting the drive circuits 359 including the ICs. Furthermore, since the wires are provided on the inner wall, then the surfaces of the electrodes 360 and 361 are covered with an insulating material.

The electrical wires 360 and 361 are connected to the drive circuits 359, and input signals and output signals are transmitted via these electrical wires. Electrical signals are input to the drive circuits 359 including the ICs via the electrical wires 360, and electrical signals output from the drive circuits 359 including the ICs are transmitted to the individual electrodes 357 via the electrical wires 361 and through electrodes 362. The drive circuits 359 including the ICs, and the surfaces of the electrical wires 360 and 361, are covered with an insulating material.

Each pressure chamber unit includes a nozzle 351 which ejects the ink 370 and a pressure chamber 352, and it is connected to a common liquid chamber 355 which supplies the ink 370 by means of a supply port 353. One surface (which corresponds to the ceiling, in FIG. 15) of each pressure chamber 352 is constituted by a diaphragm 356, and piezoelectric elements 358 which cause the diaphragm 356 to be deformed by applying pressure to the diaphragm 356 are bonded on top of the diaphragm 356. An individual electrode 357 is formed on the upper surface of each piezoelectric element 358. Moreover, the diaphragm 356 also serves as a common electrode.

Each piezoelectric element 358 is interposed between the common electrode (diaphragm 356) and an individual electrode 357, and it is deformed when a drive voltage is applied to these two electrodes 356 and 357. The diaphragm 356 is pressed by the deformation of each piezoelectric element 358, in such a manner that the volume of the corresponding pressure chamber 352 is reduced and the ink 370 is ejected from the corresponding nozzle 351. When the voltage applied between the two electrodes 356 and 357 is released, the piezoelectric element 358 returns to its original position, the volume of the pressure chamber 352 returns to its original size, and new ink 370 is supplied into the pressure chamber 352 from the common liquid chamber 355 via the supply port 353.

Figure 17A:
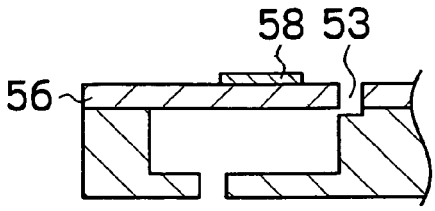
FIGS. 17A to 17G are diagrams showing steps for manufacturing a print head in a method of manufacturing a liquid ejection head according to a third embodiment of the present invention.
Figure 17B:
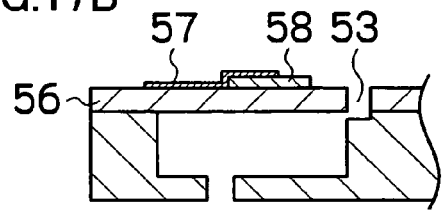

A third embodiment according to the present invention is a further method of manufacturing a liquid ejection head according to an embodiment of the present invention. This method of manufacture is described below with reference to FIGS. 17A to 17G As shown in FIG. 17A, piezoelectric elements are formed on top of the diaphragm 56 which is included in the pressure chamber units 54 shown in FIG. 4. The diaphragm 56 also serves as a common electrode and it has holes each of which constitutes a portion of an ink supply port 53. Although not shown in FIG. 17A, the surface of the diaphragm 56, which also serves as the common electrode, is covered with a thin insulating film in the regions other than the portions where piezoelectric elements 58 are formed. Thereupon, as shown in FIG. 17B, individual electrodes 57 are formed respectively on top of the piezoelectric elements 58.

Figure 17C:
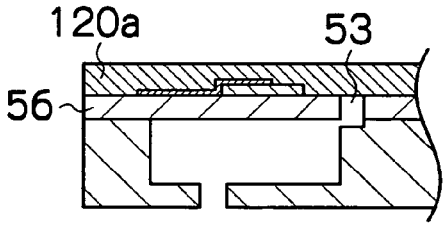
Figure 17D:
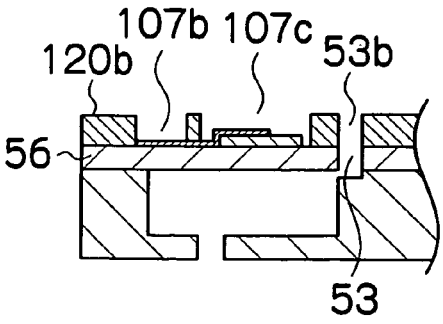

A photosensitive resin film 120*a* is then applied on the top by spin coating, or another technique, as shown in FIG. 17C. Subsequently, exposure and development are carried out using an exposure apparatus, and a portion of the photosensitive resin is removed, as shown in FIG. 17D, thereby forming spaces 107*c* for ensuring the vibration of the piezoelectric elements, electrical connection holes 107*b*, ink supply holes 53*b*, and piezoelectric element covers 120*b* for the piezoelectric elements 58. The photosensitive resin used here may be SU-8 manufactured by Kayaku Microchem Corp., but it is not limited to this material.

Figure 17E:
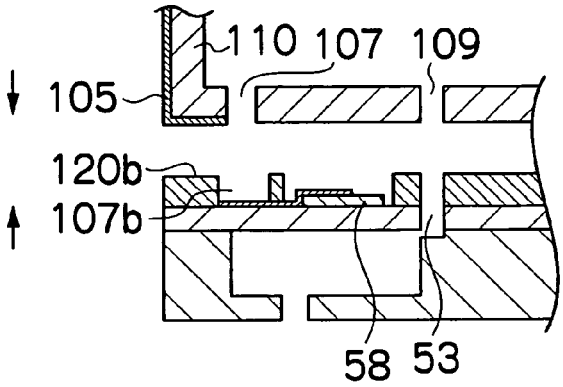
Figure 17F:
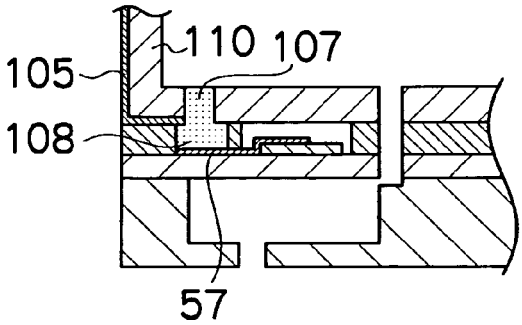
Figure 17G:
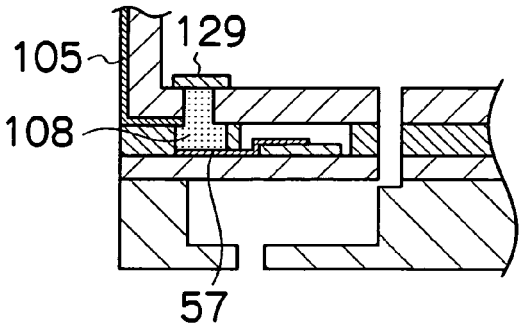

As shown in FIG. 17E, the structure thus obtained is bonded to the partition walls 110 of the common liquid chamber 55 provided with electrical wires 105 as manufactured by the process described above. In this case, position adjustment of the members is carried out before the bonding in such a manner that ink is able to pass through the ink supply ports 53. Thereupon, as shown in FIG. 17F, conductive material, such as conductive paste or solder balls, is caused to flow into the electrical connection holes 107, and solder reflow, or the like, is carried out as necessary, thereby forming through electrodes 108 which connect the individual electrodes 57 with the electrodes 105 respectively. In this process, by making the electrical connection holes 107 formed in the partition wall 110 smaller than the portions of the electrical connection holes 107*b* where the through electrodes 108 are formed, it is possible to achieve reliable electrical connections between the individual electrodes 57 and the electrodes 105. Thereupon, a liquid ejection head is completed by forming an insulating film 129 on the surface of each through electrode 108, as shown in FIG. 17G.

A fourth embodiment according to the present invention relates to a further method of manufacturing a liquid ejection head according to an embodiment of the present invention. This method of manufacture is described below with reference to FIGS. 18A to 18G.

Figure 18A:
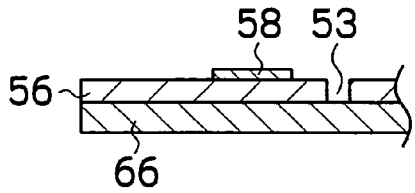
FIGS. 18A to 18G are diagrams showing steps for manufacturing a print head in a method of manufacturing a liquid ejection head according to a fourth embodiment of the present invention.
Figure 18B:
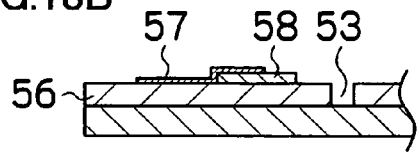

As shown in FIG. 18A, on top of a dummy substrate 66, piezoelectric elements 58 are formed on a diaphragm 56 which also serves as a common electrode and has holes that constitute a portion of the ink supply ports 53 respectively. Furthermore, although not shown in the FIG. 18A, the surface of the diaphragm 56, which also serves as the common electrode, is covered with a thin insulating film in the regions other than the portions where the piezoelectric elements 58 are formed. Thereupon, as shown in FIG. 18B, individual electrodes 57 are formed on top of the piezoelectric elements 58 respectively.

Figure 18C:
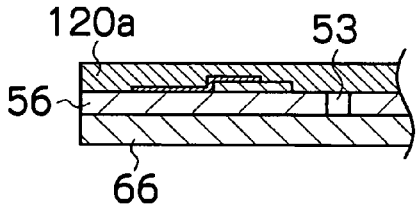
Figure 18D:
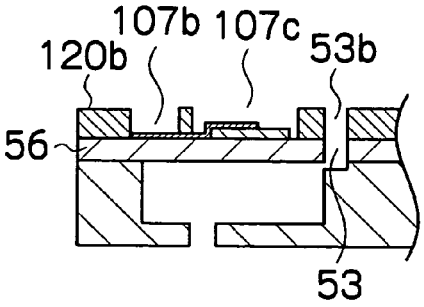

A photosensitive resin film 120*a* is then applied on the top by spin coating, or another technique, as shown in FIG. 18C. Subsequently, exposure and development are carried out using an exposure apparatus, and a portion of the photosensitive resin is removed, as shown in FIG. 18D, thereby forming spaces 107*c* for ensuring the vibration of the piezoelectric elements, electrical connection holes 107*b*, ink supply holes 53*b*, and piezoelectric element covers 120*b* for the piezoelectric elements 58. The photosensitive resin used here may be SU-8 manufactured by Kayaku Microchem Corp., but it is not limited to this material. Subsequently, the dummy substrate 66 is removed, and the members constituting pressure chamber units 54 as shown in FIG. 4 are attached, thereby obtaining the structure shown in FIG. 18F.

Figure 18E:
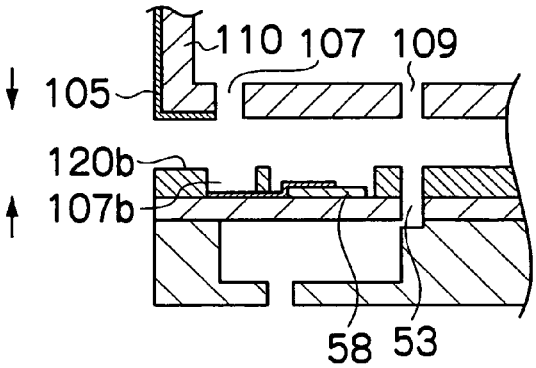
Figure 18F:
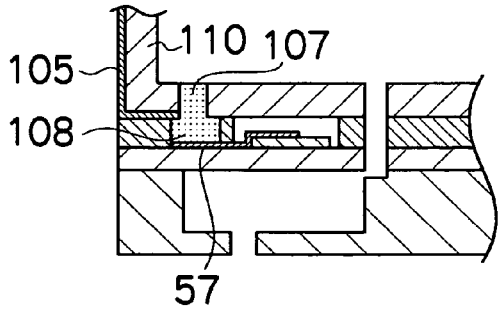
Figure 18G:
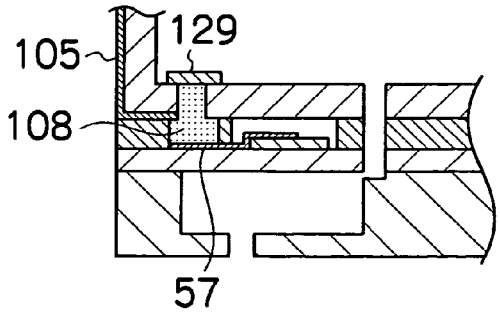

As shown in FIG. 18E, the structure thus obtained is bonded to the partition walls 110 of the common liquid chamber 55 installed with the electrical wires 105 as manufactured by the process described above. In this case, position adjustment of the members is carried out before the bonding in such a manner that ink is able to pass through the ink supply ports 53. Thereupon, as shown in FIG. 18F, conductive material, such as conductive paste or solder balls, is caused to flow into the electrical connection holes 107, and solder reflow, or the like, is carried out as necessary, thereby forming through electrodes 108 which connect the individual electrodes 57 with the electrodes 105 respectively. In this process, by making the electrical connection holes 107 formed in the partition wall 110 smaller than the portions of the electrical connection holes 107*b* where the through electrodes 108 are formed, it is possible to achieve reliable electrical connections between the individual electrodes 57 and the electrodes 105. Thereupon, a liquid ejection head is completed by forming an insulating film 129 on the surface of each through electrode 108, as shown in FIG. 18G.

A liquid ejection head, a method of manufacturing a liquid ejection head, and an image forming apparatus comprising a liquid ejection head according to the present invention are described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head comprising:

a piezoelectric body which generates pressure for ejecting liquid;

a pressure chamber which is connected to a nozzle;

a common liquid chamber which is arranged across the piezoelectric body from the pressure chamber and has at least five molded walls that are integrally molded from a resin material;

groove-shaped wires which include a first wire and a second wire and are formed on at least two of the molded walls of the common liquid chamber;

a liquid supply flow channel which is provided in one of the molded walls that is adjacent to the pressure chamber in such a manner that the liquid supply flow channel is connected with the pressure chamber; and an electronic circuit which is arranged on one of the molded walls of the common liquid chamber, wherein the first wire is connected to the piezoelectric body and the second wire is connected to the electronic circuit.

2. The liquid ejection head as defined in claim 1, wherein the groove-shaped wires are formed on outer surfaces of the at least two of the molded walls of the common liquid chamber.

3. The liquid ejection head as defined in claim 1, wherein the molded walls of the common liquid chamber are formed from an epoxy resin containing inorganic particle fillers.

4. The liquid ejection head as defined in claim 1, further comprising a piezoelectric body cover which is installed so as to create a space above the piezoelectric body and which includes a first electrical connection hole, wherein:

one of the molded walls of the common liquid chamber includes a second electrical connection hole;

a conductive material is filled into both of the first electrical connection hole and the second electrical connection hole; and a diameter of the first electrical connection hole is greater than a diameter of the second electrical connection hole.

5. An image forming apparatus comprising the liquid ejection head as defined in claim 1.

* * * * *